US005496188A

United States Patent [19]

Okamura et al.

[11] Patent Number: 5,496,188

[45] Date of Patent: Mar. 5, 1996

[54] CONNECTOR

[75] Inventors: Kenji Okamura; Shigeki Murayama; Masamitsu Chishima; Yutaka Noro, all of Yokkaichi, Japan

[73] Assignee: Sumitomo Wiring Systems, Ltd., Yokkaichi, Japan

[21] Appl. No.: 161,573

[22] Filed: Dec. 6, 1993

[30] Foreign Application Priority Data

Dec. 9, 1992 [JP] Japan ..... 4-329476

[51] Int. Cl.[6] ..... H01R 31/08

[52] U.S. Cl. ..... 439/189; 439/511

[58] Field of Search ..... 439/189, 507–515, 439/723, 725

[56] References Cited

U.S. PATENT DOCUMENTS

| | | | |
|---|---|---|---|
| 4,952,155 | 8/1990 | Kuzuno et al. | 439/189 |
| 5,000,699 | 3/1991 | Nadin | 439/189 |
| 5,201,667 | 4/1993 | Endo et al. | 439/189 |
| 5,201,668 | 4/1993 | Endo et al. | 439/189 |
| 5,326,275 | 7/1994 | Murakami | 439/189 |
| 5,403,204 | 4/1995 | Chrishima et al. | 439/721 |

FOREIGN PATENT DOCUMENTS 2-21107 5/1990 Japan .

*Primary Examiner*—Gary F. Paumen
*Assistant Examiner*—Hien D. Vu
*Attorney, Agent, or Firm*—Sandler, Greenblum, & Bernstein

[57] ABSTRACT

A connector includes a connector housing and a branched joint terminal for branching a primary line to a plurality of secondary lines. The connector housing has a plurality of terminal housing extending parallel to each other and opening at the front side for accommodating one terminal connected to the primary line or to the secondary line (5B). The connector housing is provided with grooves extending between the side walls thereof and crossing the terminal housing. Thus extended formed groove is also opened at the front side for receiving the joint terminal therein. When joint terminal is placed in the groove, the first and second terminals accommodated in the terminal housing are electrically connected through the joint terminal so that the primary line is branched and connected to the secondary terminals.

16 Claims, 4 Drawing Sheets

CONNECTOR

BACKGROUND OF THE INVENTION

1. Field of the Invention

The present invention relates to a connector for making a branch circuit for connecting an outlet line from the main to a plurality of electric wires from devices and, more particularly, to a connector having a primary terminal and a plurality of secondary terminals accommodated in a housing thereof and a joint terminal made by an electrically conductive plate for branching the primary terminal to connect the secondary terminals. In the present invention, the connector with a simplified construction is provided for easily making a branch connection between terminals only by inserting the joint terminal to the connector housing, so that the number of required component parts as well as the difficulties of the operation can be reduced.

2. Description of the Prior Art

In FIGS. 6, 7A, and 7B, a conventional connector of this kind, for example, proposed in Japanese Patent Publication No. H2-21107 published May 11, 1990 is shown.

The conventional connector has a cover housing 2 with a joint terminal 1 having a plurality of joint contacts 1*b* planted therein with a predetermined pitch and a connector housing 3 engagable to the cover housing 2. The connector housing 3 has a plurality of terminal cavities 3*a* formed therein each for receiving a solderless terminal 6 crimped to a primary line 5A or a plurality of secondary lines 5B. In FIG. 6, only one of secondary lines 5B is shown for the sake of brevity. When thus assembled connector housing 3 is engaged to the cover housing 2, the primary line 5A is connected to each of secondary lines 5B in parallel through the joint terminal 1.

As best shown in FIG. 7B, joint contacts 1*b* are mutually connected by a connection part 1*a* and are arranged on plural lines, for example two, parallel to each other. The joint contact 1*b* extends longitudinally below the connected part thereof so as to form a root portion 1*c*. Thus formed joint terminal 1 is inserted with a pressure toward the bottom portion 2*a* of the cover housing 2 such that root portions 1*c* are engaged with corresponding channels 2*b* formed in the bottom portion 2*a*. Thus assembled cover connector 2 is used for the electrical connection of the terminals.

The solderless terminal 6 has a contact part 6*a* formed on the top end thereof for the electrical connection with the joint terminal 1. The contact part 6*a* has a pair of spring parts 6*a*-1 and 6*a*-2 opposing to each other. When the connector housing 3 with terminals 6 is engaged with the cover housing 2, each of joint contact 1*b* is received between the spring parts 6*a*-1 and 6*a*-2, and the primary line 5A is branched and connected to each of the secondary lines 5B in parallel through the joint terminal 1.

In conventional connectors, there are many parts such as joint terminal 1 made of metallic material, cover housing 2, connector housing 3, and solder less terminals 6 are necessary. As the number of necessary components increases, the number of operations required for preparing the connector, resulting in the increased cost. It is to be noted that the cover housing 2 should be equipped with a joint terminal 1 having required number of electrode members having joint contacts 1*b* and root parts 1*c*, and the connector housing 3 should also be equipped with solderless terminals 6, respectively, before the engaging operation therebetween.

Furthermore, it is impossible to completely install and fix the joint terminal 1 to the cover housing 2 such that the root parts 1*c* are pressure inserted to the channels 2*b* formed in the bottom of the cover housing 2, even if any part of the joint terminal 1, made by a metal plate, is deformed. Particularly, in a multi-electrodes connector having a plurality of joint contacts 1*c*, it is very difficult to set root parts 1*c* and corresponding channels 2*b* on aligned positions, causing the great difficulties in the assembling work by the operator.

SUMMARY OF THE INVENTION

The present invention has been developed with a view to substantially solving the above described disadvantages and has for its essential object to provide an improved connector.

In order to achieve the aforementioned objective, a connector for electrically connecting a primary line connected to a first terminal to a plurality of secondary lines each connected to a second terminal, said connector comprises joint terminal means made by an electrically conductive material; and housing means having a plurality of terminal housing means extending in a first direction and opening at one end for accommodating either one of said first and second terminals therein, each of said terminal housing means being in alignment with each other side by side, said housing means being provided with a groove means extending in a second direction and opening at said first end for receiving said joint terminal means, whereby when said joint terminal means is placed in said groove means, said first and second terminals accommodated in said terminal housing means are electrically connected through said joint terminal so that said primary line is electrically connected to said secondary terminals.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
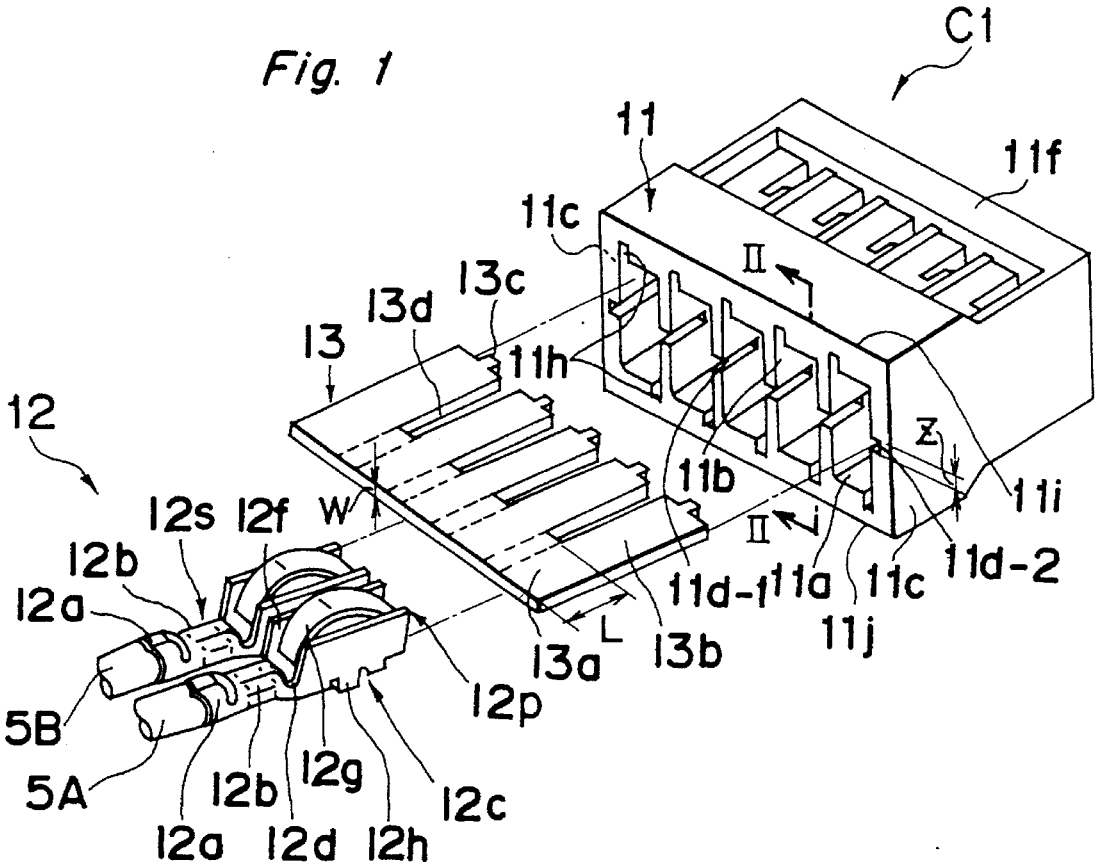
FIG. 1 is a perspective exploded view showing a connector according to a first embodiment of the present invention.

Referring to FIG. 1, a connector according to a first embodiment of the present invention is shown. The connector C1 includes a connector housing 11, a solderless terminal 12 crimped to a primary line 5A and a plurality of solderless terminals 12 crimped to secondary line 5B, and a joint terminal 13. Only one of secondary line 5B crimped to the terminal 12 is shown in FIG. 1 for the sake of brevity.

In this type of connector, after joint terminal 13 is directly installed in the connector housing 11 to prepare the terminal housings, the terminals 12 are inserted to thus prepared terminal housings, in which the primary line 5A is branched to connect to the secondary line 5B through the terminals and the joint terminals. In the connector, it is also possible to connect a single primary line 5A to a single secondary line.

The connector housing 11 is generally rectangular box-like shape, and has a horizontal top wall 11*i*, a bottom wall 11*j*, and side walls 11*c*, and a back wall 11*f* such that the connector housing 11 is opened at front side and closed by the back wall 11*f* opposed to the front side. The connector housing 11 is made of an electrically insulation material such as resin and is formed with a plurality of terminal receiving grooves 11*a* which are aligned in two horizontal rows, one above the other.

On the top surface of the bottom wall 11*j*, a plurality of spacer walls 11*b* are formed, projecting toward the top wall and having a predetermined clearance from the lower surface of the top wall 11*i*. The spacer walls 11*b* are extending from the front side to the back side of the connector housing 10. Thus, the lower row space is divided into a plurality of elongated cavities, each serving as a terminal receiving groove 11*a* in the lower row space. Also on the lower surface of the top wall 11*i*, a plurality of spacer walls 11*b* are provided in a manner similar to those provided on the bottom wall 11*j*, forming a plurality of terminal receiving grooves 11*a* in the upper row space. A joint channel 11*d*-1 is formed between the opposing spacer walls 11*b* extending from the top wall 11*i* and the bottom wall 11*j* for receiving the joint terminal 13, and has a predetermined clearance Z. The joint channel 11*d*-1 extends from the middle of the spacer wall 11*b* and is opened at the front side.

A side groove 11*d*-2 is formed on each inside surface of side walls 11*c* at the same horizontal positions as the joint channels 11*d*-1 and has the same clearance Z defined between the opposed horizontal sides formed in the side walls 11*c*. The side groove 11*d*-2 is opened at the front side and extends till the back wall 11*f*. The joint channel 11*d*-1 has a cross-sectional configuration similar to that of a base portion 13*a* of joint terminal 13.

When is viewed the connector housing 11 from the left or right side, the joint channels 11*d*-1 and side grooves 11*d*-2 are aligned to define a joint terminal insertion space which opens at the front side.

Figure 2:
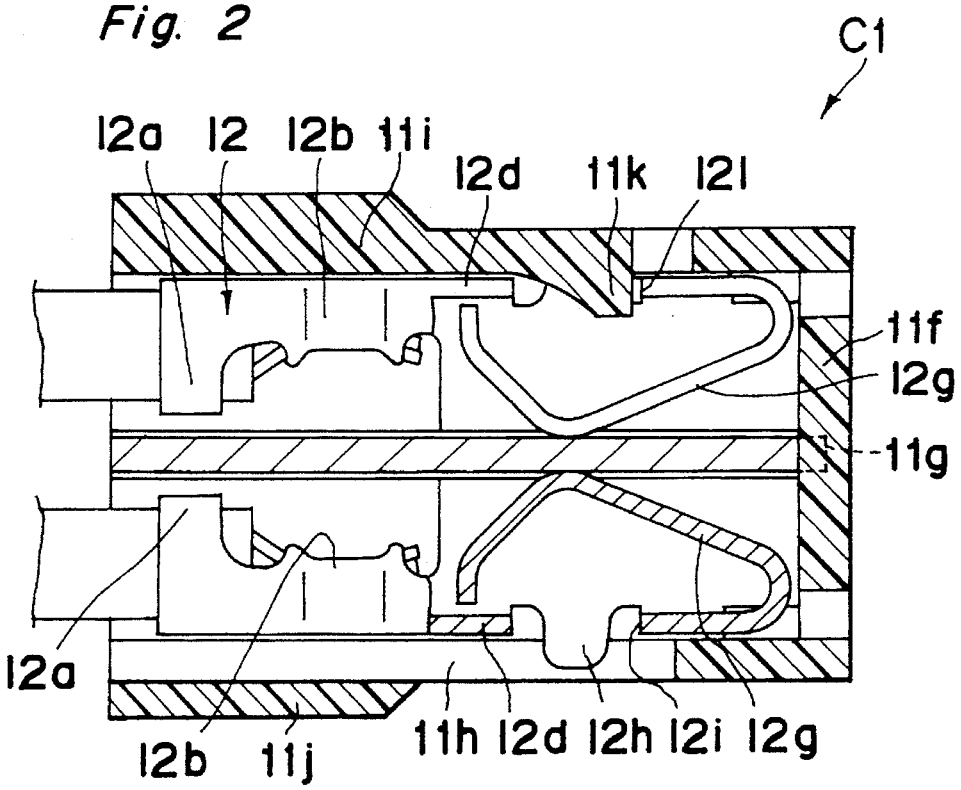
FIG. 2 is a cross-sectional view showing the connector taken along a line II—II of FIG. 1, when assembled.

A tab's end receiving groove 11*g* is formed in the inside surface of the back wall 11*f*, between opposing terminal receiving grooves 11*a*, at the same horizontal positions as the joint channels 11*d*-1, as best shown in FIG. 2.

A guide channel 11*h* is formed in the top wall 11*i* extending adjacent and parallel to each of walls 11*c* and 11*b* which define the left sides of the upper row terminal receiving grooves 11*a*.

Also at the bottom wall 11*j*, a guide channel 11*h* is formed extending adjacent and parallel to each of walls 11*c* and 11*b* which define the right sides of the lower row terminal receiving grooves 11*a*.

As best shown in FIG. 2, a lance 11*k* is integrally formed with the top and bottom walls 11*i* and 11*j* of each of the terminal receiving grooves 11*a* in the connector housing 10. The lance 11*k* has a tapered tip projecting inside the groove 11*a* and a vertical end.

The solderless terminal 12 is formed by bending a metal plate and has barrel portion 12*a* and 12*b* at one side for crimping either one of the primary line 5A and the secondary line 5B. Hereinafter, the solderless terminals 12 crimped to the primary line 5A and 5B are refereed to as a primary terminal 12*p* and a secondary terminal 12*s*, respectively. A pair of side guides 12*c* are formed on the other end of the terminal 12 by bending up both sides of the metal plate. The solderless terminal 12 further has a spring contact 12*g* provided between the side guides 12*c* and 12*d*. This spring contact 12*g* is formed by resiliently bending back the center portion of the metal plate in a curved shape such that the curved portion protrudes from the upper edge of the side guides 12*c* and 12*d*. The spring contact 12*g* is resiliently biased upward.

A guide tab 12*h* is formed on the bottom edge of side guide 12*c* extending downward therefrom. The terminal 12 is further provided with a lance engaging hole 12*i* formed in the base plate opposing to the spring contact 12*g*, as best shown in FIG. 2.

The joint terminal 13 is formed by an electrically conductive material such as a metal plate in an elongated flat comb-like configuration having a predetermined thickness W. The thickness W is substantially the same as the thickness Z of joint channels 11*d*-1 and side grooves 11*d*-2. The joint terminal 13 has an base plate portion 13*a* elongating in a direction and a plurality of flat tabs 13*b* horizontally extending from the one of longitudinal side of the base plate portion 13*a*. The base plate portion has the length substantially the same as that of the joint terminal insertion space formed in the connector housing 11, and has a width L.

Each of flat tab 13*b* is formed in rectangular plate-like shape having a width substantially the same as the internal width of the groove 11*a*, and is apart from each other by a predetermined slit clearance 13*d* which is substantially same as the width of the side walls 11*c*. The width L of the base plate portion 13*a* is also substantially the same as the length of the joint channel 11*d*-1. A projection 13*c* is provided at the free end of the flat tab 13*b* and formed in a shape engagable with the tab's end receiving groove 11*g* formed in the bottom wall 11*f* of the connector housing 11.

Next, the assembling process of the connector C1 is described. At the first step, the joint terminal 13 is inserted in the joint terminal insertion space opened at the front side of the connector housing 11 by pressing the back side opposing to the flat tabs side. The outer side edges of the terminal 13 fit in and guided by the side grooves 11*d*-2. Further pressing causes the projection tabs 13*c* fit in the tab's end receiving grooves 11*g*, and then the joint terminal 13 stops thereat. In this case, the areas of base plate portion 13*a* continuous to the slits 13*d*, confined by dot lines in FIG. 1, are received in the joint channels 11*d*-1. And, the back side of the joint terminal 13 is aligned with the front edge of the connector housing 11. Thus the upper row terminal receiving grooves 11*a* and lower row terminal receiving grooves 11*a* are separated by the joint terminal 13 made by a metal plate, so that individual terminal housings 11*a*.

At the second step, the primary terminal 12*p* is inserted in one of the terminal housings 11*a* properly with the guide tab 12*h* guided by the guide channel 11*h*. During the insertion, the spring contact 12*g* is kept in contact with the electrical conductive surface of flat tab 13*b* of joint terminal 13. The terminal 12*p* is further inserted until the lance engaging hole 12*i* engages with the tapered tip of the lance 11*k*, and is fully engaged at this position such that spring contacts 12*g* is securedly in contact to the conductive surfaces of the flat tabs 13 of the joint terminal 13. Similarly, the secondary terminals 12*s* are inserted and fully engaged in other terminals housings 11*a*, respectively. On this fully engaged position, the spring contacts 12*g* of primary terminal 12*p* and secondary terminals 12*s* are electrically connected through the conductive surfaces of joint terminal 13, so that the primary line 5A is branched and connected to a plurality of secondary lines 5B in parallel.

With the joint terminal 13 shown in FIG. 1, all terminals 12*p* and 12*s* installed in each of individual terminal housings 11*a* are electrically connected mutually. However, it is also possible to select a combination of terminals 12 to be electrically connected by optionally cutting the base plate portion 13*a* of joint terminal 13 along dot lines (FIG. 1) to separate it in some segments.

Figure 3:
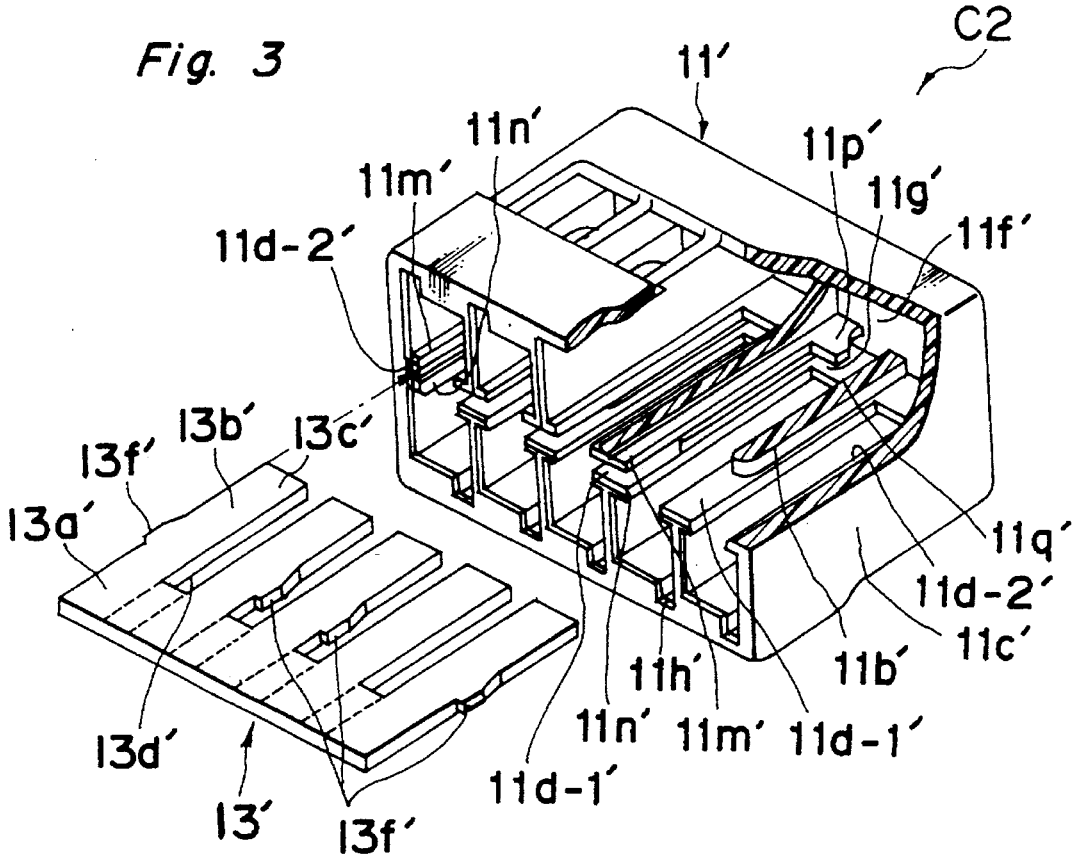
FIG. 3 is perspective exploded view showing a connector according to a second embodiment of the present invention in which a portion is cut away.
Figure 4:
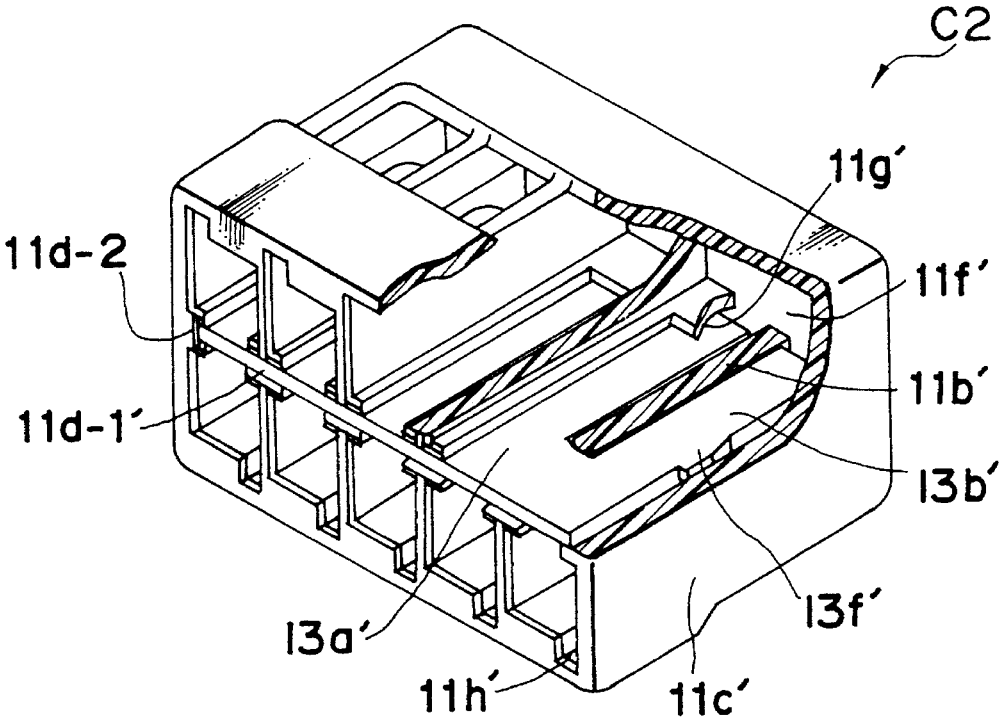
FIG. 4 is a perspective view showing the connector of FIG. 3, when assembled.

Referring to FIGS. 3 and 4, a connector according to a second embodiment of the present invention is shown. The connector C2 has a connector housing 11' and a joint terminal 13' having constructions similar to those of the connector C1. In the connector housing 11', a lower horizontal tab 11*n'* is formed on the top edge of each spacer wall 11*b'* of the lower row grooves 11*a* and is extending in horizontal directions toward both side walls 11*c'*. Also upper horizontal tabs 11*m'* are provided on spacer walls 11*b'* of the upper row grooves 11*a* and horizontally extending in parallel to the lower horizontal tab 11*n'*. Thus, joint channels 11*d*-1' defined by opposed pair of upper and lower horizontal tabs 11*m'* and 11*n'* are formed between upper and lower terminal receiving grooves 11*a'*.

Also, from the inner surface of each side wall 11*c'*, the upper and lower horizontal tabs 11*m'* and 11*n'* are formed, so that side groove 11*d*-2' is formed on the same horizontal position as the joint channels 11*d*-1'.

Furthermore, each of upper row grooves 11*a* is provided with an upper rim 11*p'* formed on bottom wall 11*f'* at the same horizontal position as the upper horizontal tabs 11*m'*. The upper rim 11*p'* is continuous to the upper horizontal tabs 11*m'* formed on both sided spacer walls 11*b'* defining a single of groove 11*a*. Similarly, lower rim 11*q'* continuous to both the lower horizontal tabs 11*n'* is provided in each of lower row grooves 11*a*.

A tab's end receiving groove 11*g'* is formed between thus formed upper and lower rims 11*p'* and 11*q'* for receiving a free end 13*c'* of each flat tab 13*b'* of the branched terminal 13'. As best shown in FIG. 3, the free end 13*c* is flat and is not provided with a projected portion such as the projection tab 13*c* according to the first embodiment. However, the flat tab 13*b'* has a side projection 13*f'* formed at one of side edges thereof and extending horizontally therefrom.

Thus formed joint terminal 13' can be inserted in the joint terminal insertion space which is defined by the joint grooves 11*d*-1', side channels 11*d*-2' and tab's end receiving grooves 11*g'* and is opened at the front side of the connector housing 11'. In this case, the side portion of the flat tab 13*b'* can be inserted thereto smoothly by inserting thereof such that the both side portions of the flat tab 13*b'* is inserted to and guided between the upper and lower horizontal tabs 11*m'* and 11*n'*.

Further pressing causes each end of tabs 13*c'* to fit in the tab's end receiving groove 11*g'* such that tab's end 13*c'* is entirely held between the upper and lower rims 11*p'* and 11*q'* with respect to the width of the tab 13*b'*. Furthermore, each of side projections 13*f'* trespasses the end of joint groove 11*d*-1' and is pressedly engaged with the spacer wall 11*b'*. Similarly the right sided projection 13*f'* is pressedly engaged with the side wall 11*c'*.

The connector housing 11' thus assembled with the joint terminal 13' is used for the electrical connection between the primary terminal and the secondary terminals which are inserted in a manner similar to that according to the first embodiment.

As described in the above, the joint terminal 13' is installed to the connector housing 11' such that both side portions of each flat tab 13*b* is inserted to and guided between the upper and lower horizontal tabs 11*m'* and 11*n'*. Therefore, the joint terminal 13' comprising a plurality of flat tabs 13*b'* for the connection of multiple electrodes can be easily installed in the connector housing 11'. Even if any of those plural flat tabs 13*b'* is sightly deformed or bent by an accident, such deformation or bending of the flat tab 13 can be easily straightened by the tabs 11*m'* and 11*n'* and lead toward the tab's end receiving groove 11*g'*.

Furthermore, as best shown in FIG. 4, since both sides of the flat tab 13*b'* are supported by the horizontal tabs 11*m'* and 11*n'* against the force in the vertical direction, the joint terminal 13' is firmly held inside the connector housing 11'.

It is needless to say that it is also possible to select the combination of terminals 12*p* and 12*s* to be electrically connected by cutting the base plate portion 13*a'*of joint terminal 13' along dot lines (FIG. 3). Even when the joint terminal 13' is cut into some separated segments, however, each segmented flat tabs 13*b'* can be firmly held in the connector housing 11' by such engaging means as an upper tab 11*m'* and a lower tab 11*n'* and a side projection 13*f'*.

Figure 5A:
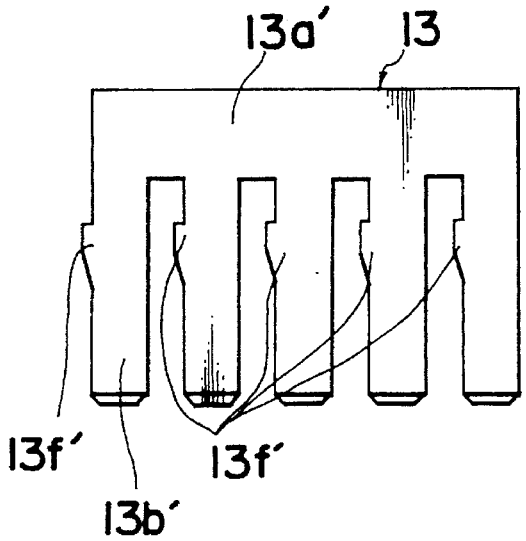
FIG. 5A, 5B, and 5C are views showing various joint terminals according to the present invention.
Figure 5B:
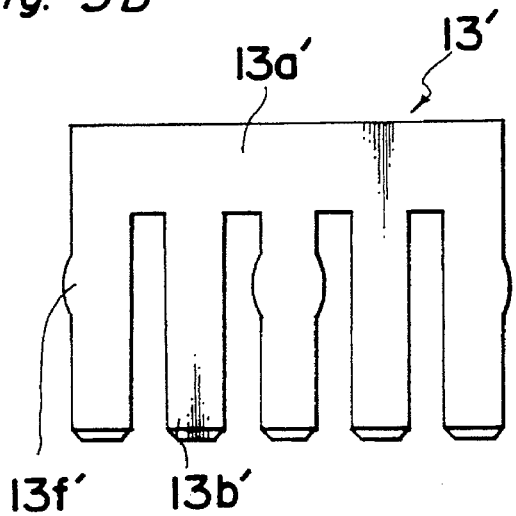
Figure 5C:
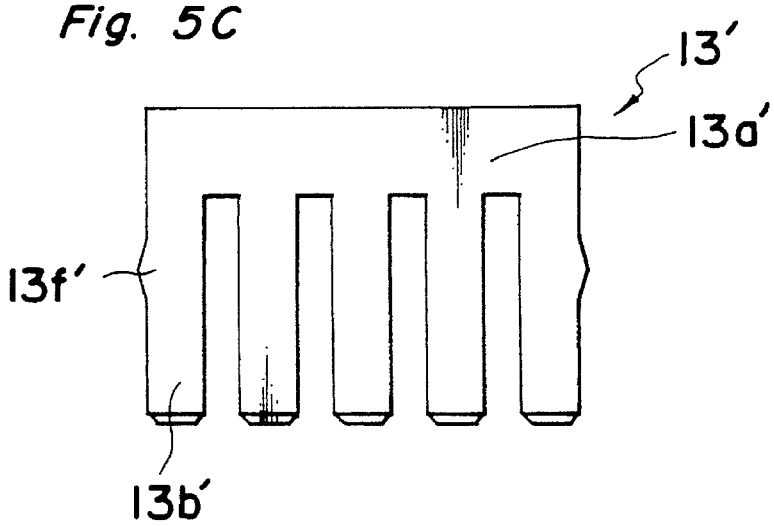
Figure 6:
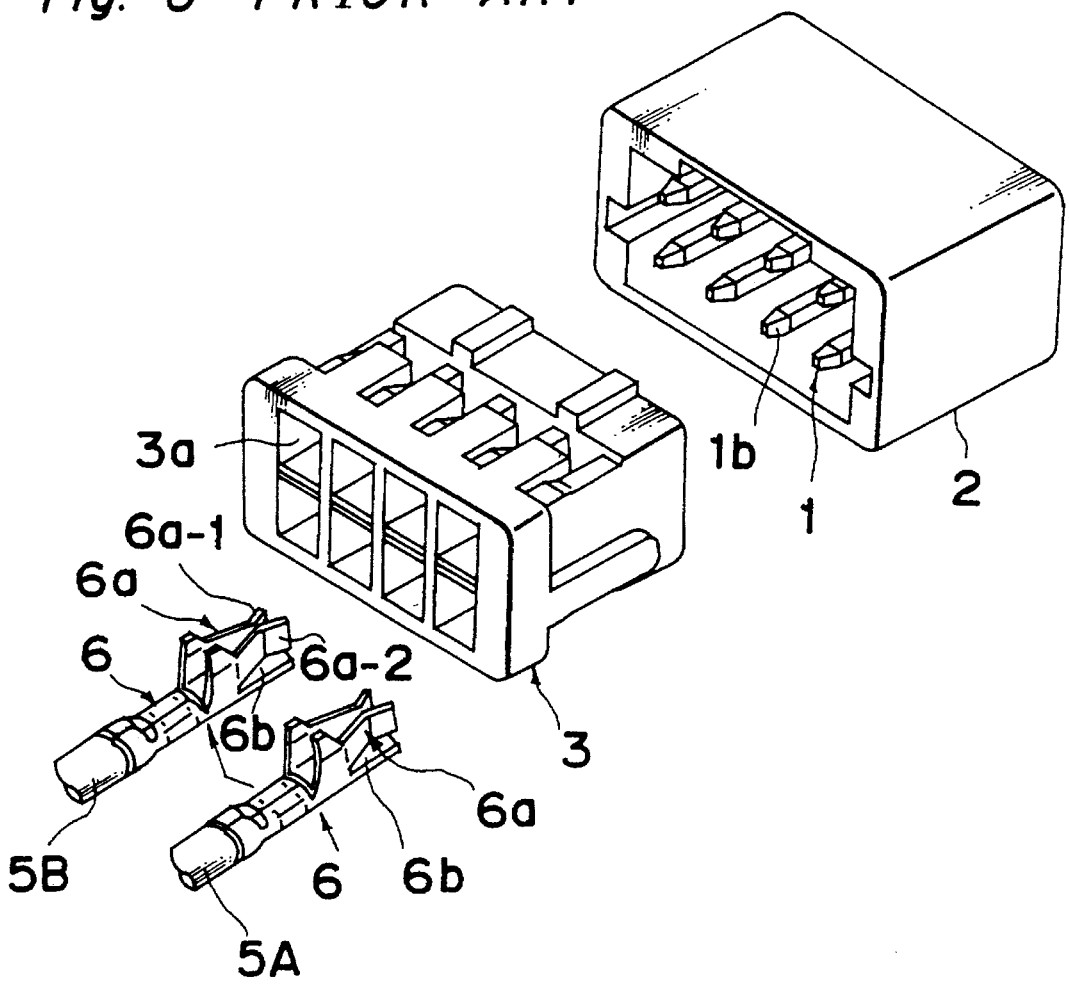
Fig. 6 PRIOR ART
FIG. 6 is a perspective exploded view showing a conventional connector.
Figure 7A:
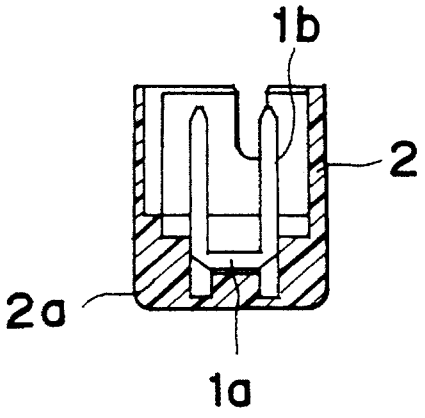
Fig. 7A PRIOR ART
FIGS. 7A and 7B are cross-sectional views showing a cover housing with a joint terminal installed therein.
Figure 7B:
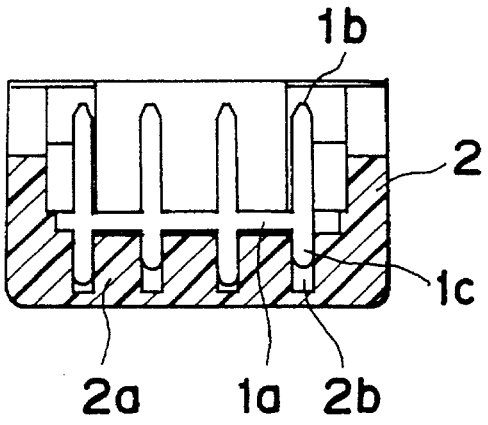
Fig. 7B PRIOR ART

It is to be noted that the side projection 13*f'* can be formed in other shapes than shown in FIG. 3, and can be formed, for example, in shapes shown in FIGS. 5A, 5B, and 5C.

In FIG. 5A, the side projections 13*f'* formed in generally a wedge shape are shown. Each of wedge shaped side projection 13*f'* is provided on the same side, shown left in Figure, of each flat tabs 13*b'*.

In FIG. 5B, the side projections 13*f'* formed in an arched shape are shown. In this case, the arched side projections 13*f'* are provided on outer sides of the terminal 13' and the both sides of the flat tab 13*b'* located in the center of the terminal 13'.

In FIG. 5C, the side projections 13*f'* formed in generally a triangular shape are shown. Triangular side projections 13*f'* are provided on the outer sides of the terminal 13'.

The side projection 13*f'* can be formed in such a shape and a location that the joint terminal 13' can be inserted to the connector housing 11' with those side projection 13*f'* pressedly engaged with the spacer walls 11*b'*. It is needless to say that these side projection 13*f'* can be provided on the joint terminal 13 of the first embodiment.

As is clear from the above descriptions, according to the present invention, the joint connector having branched terminals is directly installed in the connector housing before the insertion of the terminals. Therefore, the present invention can provide a connector which does not need a cover housing which is required for holding the joint terminals in the conventional connectors, reducing the number of the component parts. As a result, the assembly process and the manufacturing cost of the connector can be reduced. Furthermore, the omission of the cover housing results in the connector in a compact size.

The terminal groove opened at the front side of the connector housing for receiving the joint terminal is formed by a plurality of grooves and channels aligned at the same horizontal position. Therefore, the joint terminal can be set the correct position and inserted to the terminal groove smoothly even if the joint terminal is slightly bent.

Furthermore, the joint terminal can be cut into plural joint segments separated from the other, so that the operator can easily select groups of terminals to be electrically connected at the operation site as the occasion requires. Therefore, a single unit of joint terminal can be applied to the various combination of terminals to be connected. In this sense, the manufacturing cost of the connector can be reduced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An electrical connector for electrically connecting a primary line connected to a first terminal to a plurality of secondary lines each connected to a second terminal, said connector comprising:

a substantially flat joint terminal means made by an electrically conductive material having slit clearance means; and a housing means having a plurality of terminal housing means extending in a first direction and having an opening at one end for receiving therethrough one of said first and second terminals, each of said terminal housing means being in alignment with each other side by side, said housing means being provided with a groove means extending in a second direction and opening at said one end for receiving said joint terminal means, whereby when said substantially flat joint terminal means is placed in said groove means, said first and second terminals accommodated in said terminal housing means are electrically connected through said joint terminal so that said primary line is electrically connected to said secondary terminals.

2. An electrical connector as claimed in claim 1, wherein said substantially flat joint terminal means comprises an elongated flat plate.

3. An electrical connector as claimed in claim 2, wherein said elongated flat plate comprises a base portion and a plurality of flat tabs extending horizontally from a longitudinal side of said base portion.

4. An electrical connector for making a branched circuit between a first terminal and a second terminal, said connector comprising:

a joint terminal means made by a substantially flat metal plate having an elongated base portion and a plurality of electric connection portions each extending from one side of said elongated base portion, each of electric connection portions being in alignment with each other; and a housing means having a bottom wall and side walls extending along the perimeter of said bottom wall and opening at a first side adjacent to said bottom wall, said housing means having a plurality of terminal housing means between adjacent spacing walls extending from said bottom wall and opening at said first side for accommodating either one of said first and second terminals therein, said one terminal being inserted through said opening, each of said terminal housing means being in alignment with each other side by side, said housing means being provided with an elongated groove extending between an opposed pair of said side walls through said spacing walls and opening at said first side for receiving said joint terminal means therein, whereby when said joint terminal means is placed in said elongated groove, said first and second terminals accommodated in said terminal housing are electrically connected by said electric connection portions.

5. An electrical connector as claimed in claim 4, wherein said elongated groove penetrates said spacer walls, and said connector housing is further provided with a plurality of grooves each for receiving a free end of each said electric connection portions.

6. An electrical connector as claimed in claim 4, wherein said housing means is further provided with an opposed pair of guide means formed along said elongated groove for guiding said joint terminal into said elongated groove.

7. An electrical connector as claimed in claim 4, wherein said joint terminal is provided with a side projection on a side edge of one of said electric connection portions and projecting therefrom toward an adjacent one of said electric connection portions, said side projection being pressedly engageable with said elongated groove.

8. An electrical connector as claimed in claim 4, wherein at least one of said first and second terminals is provided with a spring contact, said spring contact being in pressure contact with said electric connection portion.

9. An electrical connector as claimed in claim 4, wherein said substantially flat joint terminal means comprises an elongated flat plate.

10. An electrical connector as claimed in claim 9, wherein said elongated flat plate comprises a base portion and a plurality of flat tabs extending horizontally from a longitudinal side of said base portion.

11. An electrical connector for making a branched circuit between a first terminal and a second terminal, said connector comprising:

a joint terminal means made by a metal plate having an elongated base portion and a plurality of electric connection portions each extending from one side of said elongated base portion, each of electric connection portions being in alignment with each other; and a housing means having a bottom wall and side walls extending along the perimeter of said bottom wall and opening at a first side adjacent to said bottom wall, said housing means having a plurality of terminal housing means between adjacent spacing walls extending from said bottom wall and opening at said first side for accommodating either one of said first and second terminals therein, said one terminal being inserted through said opening, each of said terminal housing means being in alignment with each other side by side, said housing means being provided with an elongated groove extending between an opposed pair of said side walls through said spacing walls and opening at said first side for receiving said joint terminal means therein, whereby when said joint terminal means is placed in said elongated groove, said first and second terminals accommodated in said terminal housing are electrically connected by said electric connection portions, and wherein said joint terminal is provided with a side projection on a side edge of one of said electric connection portions and projecting therefrom toward an adjacent one of said electric connection portions, said side projection being pressedly engageable with said elongated groove.

12. An electrical connector as claimed in claim 11, wherein said elongated groove penetrates said spacer walls, and said connector housing is further provided with a plurality of grooves each for receiving a free end of each of said electric connection portions.

13. An electrical connector as claimed in claim 11, wherein said housing means is further provided with an opposed pair of guide means formed along said elongated groove for guiding said joint terminal into said elongated groove.

14. An electrical connector as claimed in claim 11, wherein at least one of said first and second terminals is provided with a spring contact, said spring contact being in pressure contact with said electric connection portion.

15. An electrical connector as claimed in claim 11, wherein said joint terminal means comprises an elongated flat plate.

16. An electrical connector as claimed in claim 15, wherein said elongated flat plate comprises a base portion and a plurality of flat tabs extending horizontally from a longitudinal side of said base portion.

* * * * *